US005929568A

United States Patent [19]

Eggers

[11] Patent Number: 5,929,568

[45] Date of Patent: Jul. 27, 1999

[54] INCANDESCENT BULB LUMINANCE MATCHING LED CIRCUIT

[75] Inventor: Richard B. Eggers, Kirkland, Wash.

[73] Assignee: Korry Electronics Co., Seattle, Wash.

[21] Appl. No.: 08/890,434

[22] Filed: Jul. 8, 1997

[51] Int. Cl.[6] ..... H05B 37/00

[52] U.S. Cl. ..... 315/56; 315/363

[58] Field of Search ..... 315/205, 201, 315/76, 363, 326, 56

[56] References Cited

U.S. PATENT DOCUMENTS

| | | |
|---|---|---|
| 3,723,852 | 3/1973 | Peterson et al. . |
| 4,023,111 | 5/1977 | Mortensen . |
| 4,090,189 | 5/1978 | Fisler . |
| 4,099,171 | 7/1978 | Meyer . |
| 4,160,934 | 7/1979 | Kirsch . |
| 4,329,625 | 5/1982 | Nishizawa et al. . |
| 4,394,603 | 7/1983 | Widmayer . |
| 4,504,776 | 3/1985 | Haville . |
| 4,598,198 | 7/1986 | Fayfield . |
| 4,644,229 | 2/1987 | Masaki . |
| 4,771,219 | 9/1988 | Ludolf et al. . |
| 4,864,193 | 9/1989 | Takada et al. . |
| 4,866,430 | 9/1989 | Chek . |
| 4,902,958 | 2/1990 | Cook, II . |
| 5,150,016 | 9/1992 | Sawase et al. . |
| 5,278,432 | 1/1994 | Ignatius et al. . |
| 5,374,876 | 12/1994 | Horibata et al. . |
| 5,388,357 | 2/1995 | Malita . |
| 5,418,435 | 5/1995 | Yamada . |
| 5,442,258 | 8/1995 | Shibata . |
| 5,450,301 | 9/1995 | Waltz et al. . |
| 5,457,450 | 10/1995 | Deese et al. . |
| 5,581,158 | 12/1996 | Quazi . |

*Primary Examiner*—Don Wong
*Assistant Examiner*—David H. Vu
*Attorney, Agent, or Firm*—Christensen O'Connor; Johnson & Kindness PLLC

[57] ABSTRACT

An incandescent bulb luminance matching LED circuit for causing the luminance of an LED to match the luminance of an incandescent bulb is disclosed. The incandescent bulb luminance matching LED circuit includes an input port (26, 56 or 82), an output port (28, 58 or 98), one or more light emitting diodes (22, 24, . . . or 88, 90 . . .), and a voltage (20 or 89) and/or current (50 or 86) compensation block. The compensation block(s) is connected in circuit with the light emitting diode(s) between the input port and the output port and compensates for voltage and/or current changes in the power applied to the input port such that the luminance of the LED is approximately the same as that of an incandescent bulb. In one embodiment, the compensation block comprises a zener diode (30) connected in series with the light emitting diode(s) (22, 24, . . .) between the input port (26) and the output port (28). In an alternate embodiment, the compensation block comprises one or more current diode(s) (60, 62, . . .) connected in parallel with the light emitting diode(s) (52, 54, . . .) between the input port (56) and the output port (58). In yet another embodiment, the compensation block comprises both a zener diode (92) connected in series with the light emitting diode(s) (88, 90, . . .) and a one or more current diode(s) (100, 102, . . .) connected in parallel with the light emitting diode(s) (88, 90, . . .).

32 Claims, 6 Drawing Sheets

INCANDESCENT BULB LUMINANCE MATCHING LED CIRCUIT

FIELD OF THE INVENTION

The present invention relates to luminance matching circuits, and more particularly, to LED circuits for causing the luminance characteristics of a light emitting diode (LED) to match that of an incandescent bulb.

BACKGROUND OF THE INVENTION

Incandescent bulbs are commonly used in a variety of applications to provide light. For example, incandescent bulbs may be used as a light source for illuminated switches, lighted panels, displays, legends, indicators, and in a variety of other applications.

Although incandescent bulbs may provide a satisfactory degree of illumination, they also carry with them a number of disadvantages. For example, incandescent bulbs operate at a relatively high temperature. Consequently, incandescent bulbs can generate enough heat to cause burns when used in some applications, such as in lighted switch or panel applications. In addition, incandescent bulbs have a relatively short life span, and may require frequent replacement. Likewise, many incandescent bulbs are prone to failure in high vibration environments. Finally, incandescent bulbs operate at relatively high power levels.

Light emitting diodes (LEDs) offer advantages over incandescent bulbs in each of the above areas. Thus, when compared to incandescent bulbs, LEDs produce less heat, operate for a longer life, are less prone to failure in high vibration environments, and consume less power. Because of these advantages, it is desirable to substitute LEDs for incandescent bulbs in many applications.

Unfortunately, LEDs produce a different luminance, or brightness level, than incandescent bulbs given the same input current or voltage. FIG. 1 illustrates the relative luminance of an incandescent bulb and an LED given a varying input voltage. The LED luminance curve is indicated by the reference numeral 10 while the incandescent bulb luminance curve is indicated by the reference numeral 12. As FIG. 1 illustrates, LEDs and incandescent bulbs may have quite different luminance levels over a wide range of input voltages.

Similarly, FIG. 2 illustrates the relative luminance of an incandescent bulb and an LED over a varying input current. The LED luminance is indicated by the reference numeral 14, while the incandescent bulb luminance is indicated by the reference numeral 16. As FIG. 2 illustrates, LEDs and incandescent bulbs may have quite dissimilar luminance levels depending upon the input current level.

While there are many uses in which it is desirable to replace an incandescent bulb with an LED of similar luminance, one application of particular importance is in aircraft cockpits. For many aircraft, display and indicator lights must be designed in accordance with specifications for brightness. In addition, under certain conditions, the aircraft pilot may wish to manually dim the display by adjusting a dimmer switch. If each of the lights has similar brightness characteristics, the display may be dimmed consistently. This is particularly important when the pilot is wearing night vision goggles. At such times, the pilot must be able to darken the display entirely. If any of the display lights may not be darkened, the night vision goggles may "bloom," rendering them practically useless. Accordingly, in many applications LEDs may only be substituted for incandescent bulbs if the brightness characteristics are the same.

The present invention is directed to providing a compensation circuit for matching the luminance of an LED to that of an incandescent bulb over a wide range of input currents or input voltages.

SUMMARY OF THE INVENTION

In accordance with this invention, an incandescent bulb luminance matching LED circuit that compensates at least one parameter of an input power source to cause the luminance of an LED to match that of an incandescent bulb in response to changes to the at least one parameter is provided. The circuit includes an input terminal, an output terminal, an LED, and a diode. The diode is connected in circuit with the LED between the input and output terminals. In a first embodiment of this invention, the diode is a zener diode connected in series with the LED between the input and output terminals. In this manner, the LED luminance is matched to an incandescent bulb luminance at at least one input voltage level.

In accordance with other aspects of this invention, resistors are provided in series and in parallel with the zener diode. The resistors enable the LED luminance to more closely approximate the incandescent bulb luminance, and to match the incandescent bulb luminance at at least two input voltage levels.

In accordance with further aspects of this invention, in a second embodiment of this invention the diode is a current diode connected in parallel with the LED between the input and output terminals. In this manner, LED luminance is matched to incandescent bulb luminance as a function of input current.

In accordance with still other aspects of this invention, multiple current diodes may be used to enable the LED luminance to be matched to an incandescent bulb luminance at any desired input current level.

In accordance with still further aspects of this invention, the luminance compensation circuit may drive a plurality of LEDs.

In accordance with yet other aspects of this invention, the circuits of the first and second embodiments, described above, may be used together so that LED luminance is matched to the luminance of an incandescent bulb over a wide range of input voltages and currents.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
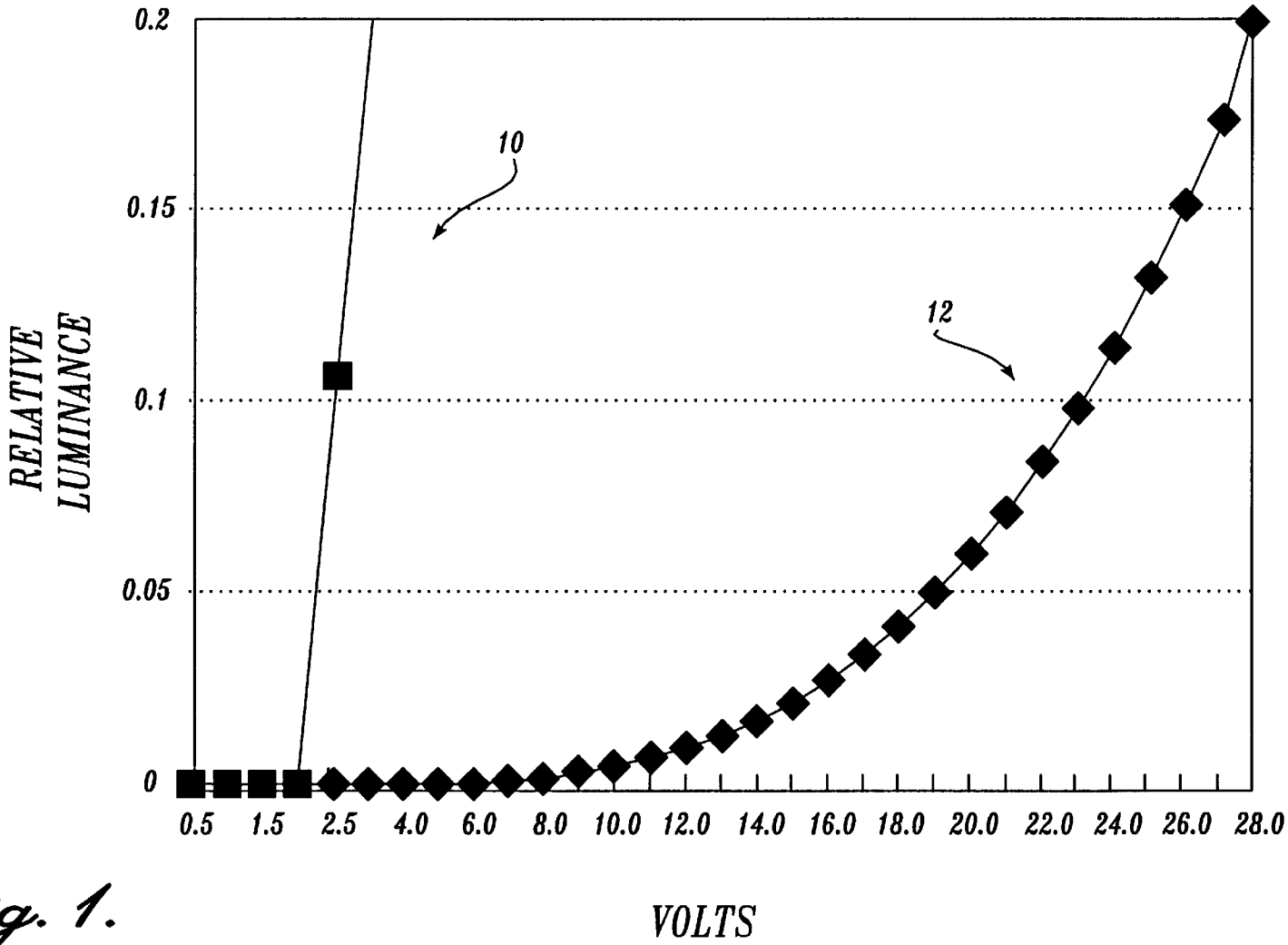
FIG. 1 is an illustration of the relative luminance of an LED and an incandescent bulb over a range of input voltages.
Figure 2:
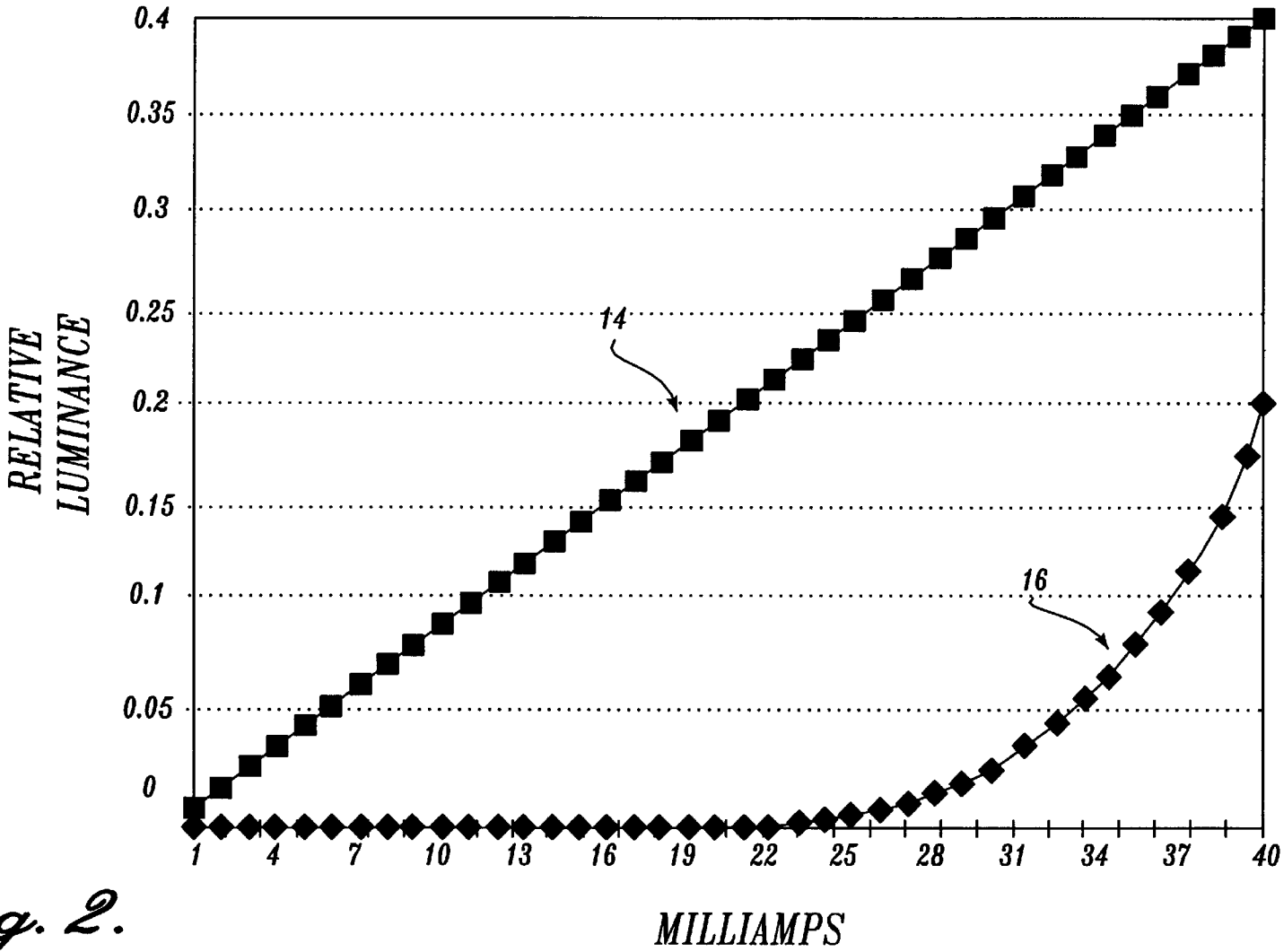
FIG. 2 is an illustration of the relevant luminance of an LED and an incandescent bulb over a range of input currents.
Figure 3:
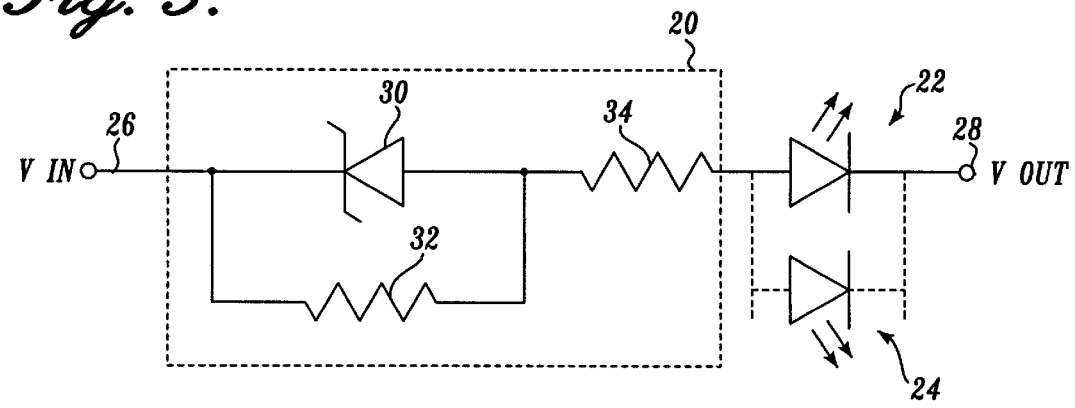
FIG. 3 is a circuit diagram of a luminance compensation circuit formed in accordance with this invention.

FIG. 3 illustrates a luminance compensation circuit formed in accordance with this invention. As will be better understood from the following description, a luminance compensation circuit formed in accordance with this invention includes a circuit for causing the luminance of an LED to more closely approximate the luminance of an incandescent bulb.

The circuit illustrated in FIG. 3 includes an input port 26, a compensation block 20, one or more LEDs 22, 24, . . . connected in parallel, and an output port 28. The compensation block 20 provides input voltage compensation and includes a zener diode 30 connected in parallel with a first resistor 32. The zener diode 30 and the first resistor 32 are connected in series with a second resistor 34. The input voltage, $V_{IN}$, is applied to the input port 26, i.e., the junction between the cathode of the zener diode 30 and the first resistor 32, and the output of the compensation block 20 is applied to the anodes of the LEDs 22, 24, . . . . The voltage return, $V_{OUT}$, is at the outport port 28.

When a relatively low input voltage (i.e., a voltage below the zener breakdown, or threshold, level) is applied to the input port 26, current will initially flow through the first resistor 32 and the second resistor 34, producing a corresponding voltage drop across the first resistor 32 and the second resistor 34. As a result, the voltage present at the LEDs 22, 24, . . . is much lower than the voltage at the input port 26.

As the voltage at the input port 26 is increased to levels at or above the zener threshold level, current will flow from the input port 26 through the zener diode 30, largely bypassing the first resistor 32. Thus, at input voltage levels approximately above the zener breakdown level, the input voltage is dropped across the second resistor 34 and the zener voltage is dropped across the first resistor 32. Consequently, there is a smaller relative reduction in the voltage level present at the anodes of the LEDs 22, 24, . . . for input voltages greater than the zener breakdown level than for input voltages less than the zener breakdown level.

Figure 5:
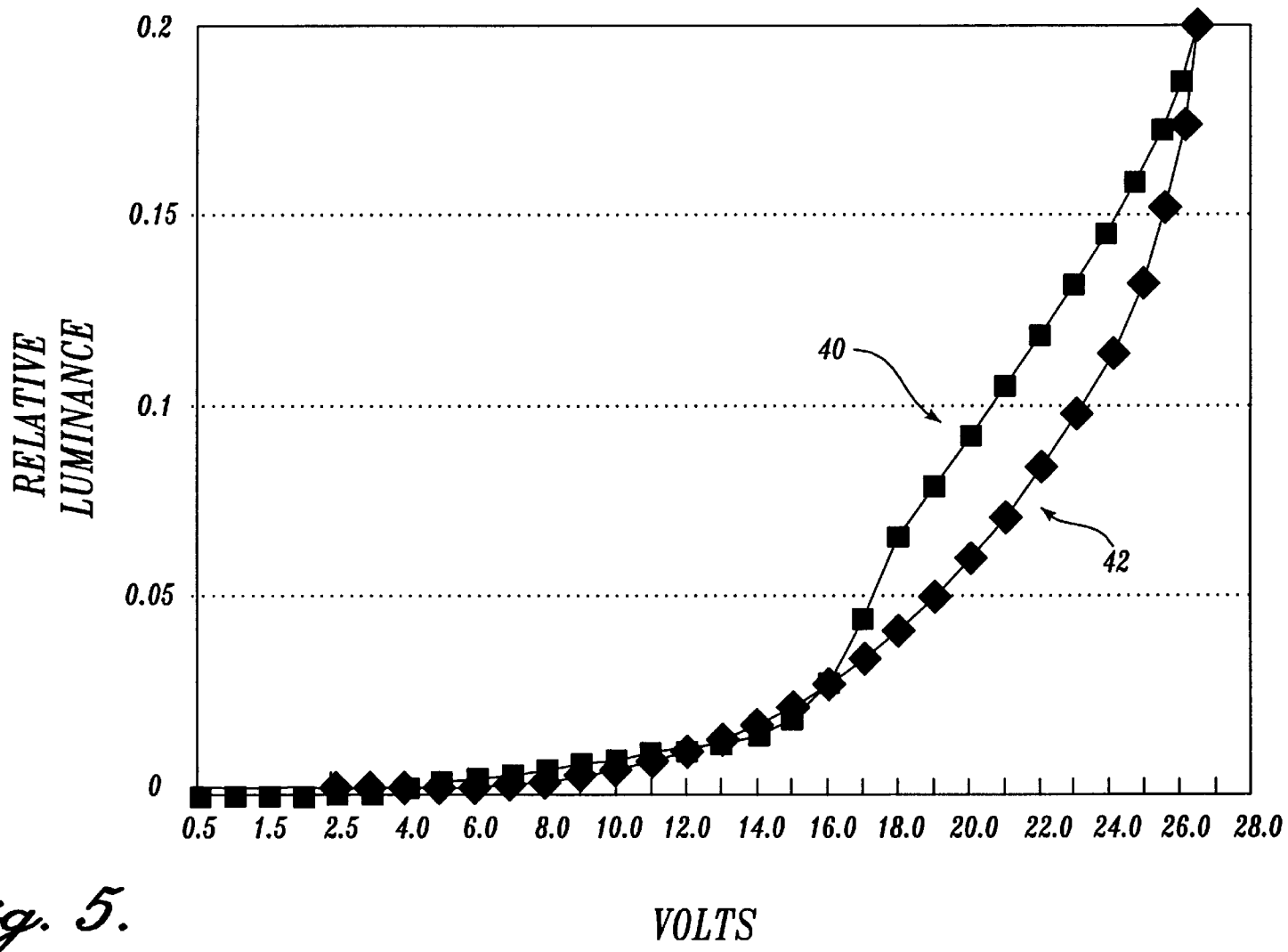
FIG. 5 is an illustration of the relative luminance of an incandescent bulb and an LED driven by a compensation circuit of the type illustrated in FIG. 3.

FIG. 5 is an illustration of the relative luminance of an incandescent bulb and an LED driven by a compensation circuit of the type shown in FIG. 3. The reference numeral 40 refers to the luminance level of the LED, while the reference numeral 42 refers to the luminance of the incandescent bulb. In this illustration, the zener diode 30, the first resistor 32, and the second resistor 34 were selected so that the LED luminance matches the incandescent luminance at input voltage levels of 12 and 26.5 volts. In between, the compensation block 20 compensates the input power source applied to the input port 26 such that the luminance of the LED 22 closely approximates that of an incandescent bulb.

In an actual embodiment, corresponding to the relative luminance curve shown in FIG. 5, the chosen zener diode 30 had a rating of 6.8 volts, the chosen first resistor had a value of 1500 ohms and the chosen second resistor had a value of 150 ohms. Thus, at input voltages below approximately 6.8 volts, little or no current flow passed through the zener diode 30. At such voltage levels, the resistance of the first resistor 32 determined the brightness of the LED 22 and the point at which the luminance of the LED 22 matched that of an incandescent bulb because, relatively, the second resistance had little effect. The value of the second resistor 34 determines the luminance of the LED 22 for input voltage levels greater than the zener threshold level. The value of the second resistor 34 also determines the point at which the luminance of the LED 22 will be equal to that of an incandescent bulb at high input levels. Those of skill in the art will recognize that the LED luminance can be matched to an incandescent bulb luminance at virtually any voltage level by selecting the proper zener diode 30, first resistor 32, and second resistor 34.

As illustrated in FIG. 3, and noted above, a single compensation circuit may be formed to drive a single or multiple LEDs. An array of LEDs may also be driven by the compensation circuit, where the array of LEDs is comprised of one or more LEDs connected in series and one or more series strings of LEDs connected in parallel. The relative luminance of all of the LEDs 24 will be matched to the luminance of an incandescent bulb. In one actual embodiment of the invention, a single compensation circuit is used to drive a total of five LEDs.

Figure 4:
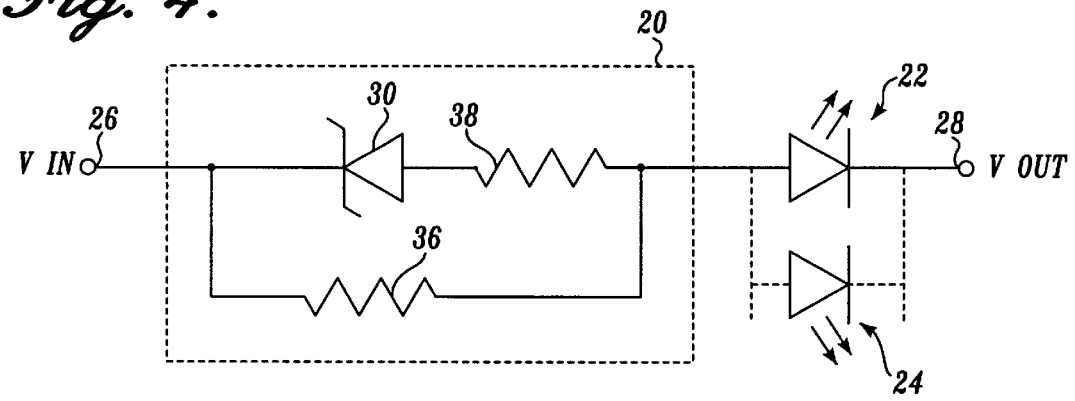
FIG. 4 is a circuit diagram of an alternate embodiment of a compensation circuit formed in accordance with this invention.

Those skilled in the art will further appreciate that the compensation block 20 can be implemented using resistors arranged other than as illustrated in FIG. 3. One alternative is illustrated in FIG. 4. In FIG. 4, the zener diode 30 of the compensation block 20 is connected in series with a first resistor 38. The zener diode 30 and first resistor 38 are connected in parallel with a second resistor 36.

The operation of the alternate embodiment illustrated in FIG. 4 is similar to the operation of the embodiment illustrated in FIG. 3. When a low input voltage (that is, a voltage less than the zener breakdown voltage level) is applied to the input port 26, except for a slight leakage current through the zener diode 30, all of the current through the compensation block 20 passes through the second resistor 36. The portion of the input voltage present at the input port 26 dropped across the second resistor 36 reduces the voltage at the anodes of the LEDs 22, 24, . . . . When the voltage at the input port 26 increases to a level above the zener breakdown voltage level, the majority of the current through the compensation block passes through the zener diode 30 and the first resistor 38. Very little current passes through the second resistor 36. Those of skill in the art will appreciate that the values of the zener diode 30, the first resistor 38, and the second resistor 36 can be selected to allow the luminance of the LED 22 to match that of an incandescent bulb at virtually any voltage level.

Unfortunately, the luminance of the LEDs 22, 24, . . . varies with increasing temperatures. In turn, the temperature of the LEDs 22, 24, . . . increases with increasing current through the LEDs 22, 24 . . . . Moreover, the actual resistances of the first and second resistors and the luminance of the LEDs 22, 24, . . . may vary substantially from their nominal or advertised values. Accordingly, the luminance of the LEDs 22, 24, . . . may be best matched to that of an incandescent bulb by trimming or tuning the resistor values while monitoring the luminance of the LEDs 22, 24, . . . .

Figure 6:
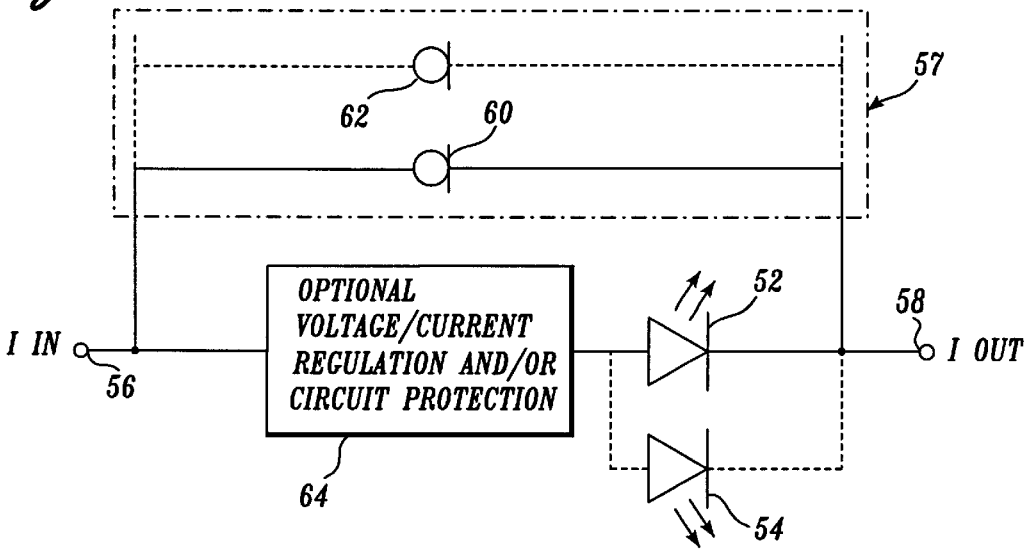
FIG. 6 is a circuit diagram of an alternate embodiment of a compensation circuit formed in accordance with this invention.

In another alternate embodiment of this invention, the compensation block can be formed to cause the luminance of an LED to match that of an incandescent bulb over a variety of input currents. As illustrated in FIG. 6, the circuit of this alternate embodiment includes an input port 56, a compensation block 57, one or more LEDs 52, 54, . . . , and an output port 58. Because the compensation block 57 of this alternate embodiment is intended to adjust the LED luminance as a function of input current, the compensation block 57 is connected in parallel with the LEDs 52, 54, . . . . More specifically, the compensation block 57, which provides input current compensation, includes one or more current diodes 60, 62, . . . connected between the input port 56 and the output port 58.

At relatively low input current levels, specifically current levels below the rated level of the current diodes 60, 62, . . . , all of the current through the circuit flows through the current diodes 60, 62, . . . , bypassing the LEDs 52, 54, . . . . When the current at the input port 56 exceeds the rated current level of the current diodes 60, 62, . . . , the current in excess of the rated current level passes through the LEDs 52, 54, . . . . Appropriate choice of the current diodes enables the compensation block 57 to cause the luminance of the LED 52 to generally match that of an incandescent bulb.

As noted above, a single current diode 60, or a plurality of current diodes 60, 62, . . . (illustrated by dashed lines in FIG. 6) may be connected in parallel. Appropriately selecting the type and number of current diodes 60, 62, . . . allows the relative luminance of the LED 52 to be matched to the luminance of an incandescent bulb at virtually any input current level.

As also noted above, the current compensation block shown in FIG. 6 may be used to drive a plurality of LEDs. That is, one or more LEDs 52, 54, . . . (shown in dashed lines in FIG. 6) may be connected to the compensation block 57. Those having skill in the art will further recognize that additional, optional circuitry such as circuitry for current or voltage regulation or circuit protection (indicated by the reference numeral 64), consistent with the present invention, may be included, if desired.

Figure 7:
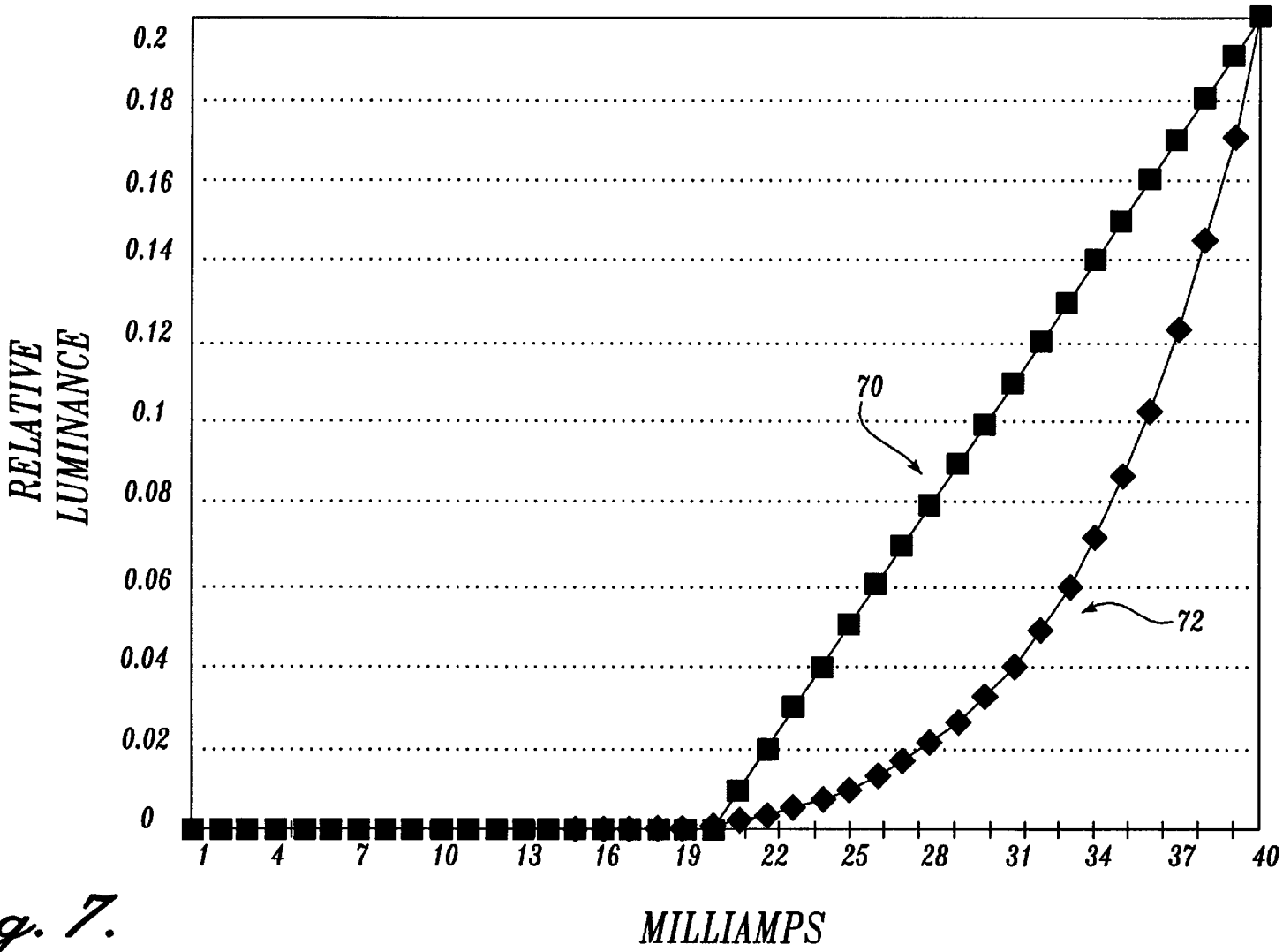
FIG. 7 is an illustration of the relative luminance of an incandescent bulb and an LED driven by a compensation circuit of the type illustrated in FIG. 6.

FIG. 7 is an illustration of the relative luminance of an incandescent bulb and an LED driven by the compensation circuit formed in accordance with this invention and illustrated in FIG. 6. The reference numeral 70 refers to the luminance of the LED 52, while the reference numeral 72 refers to the luminance of an incandescent bulb. As is illustrated in FIG. 7, the compensation circuit of this invention enables the luminance of the LED to relatively more closely approximate the luminance of the incandescent bulb.

Figure 8:
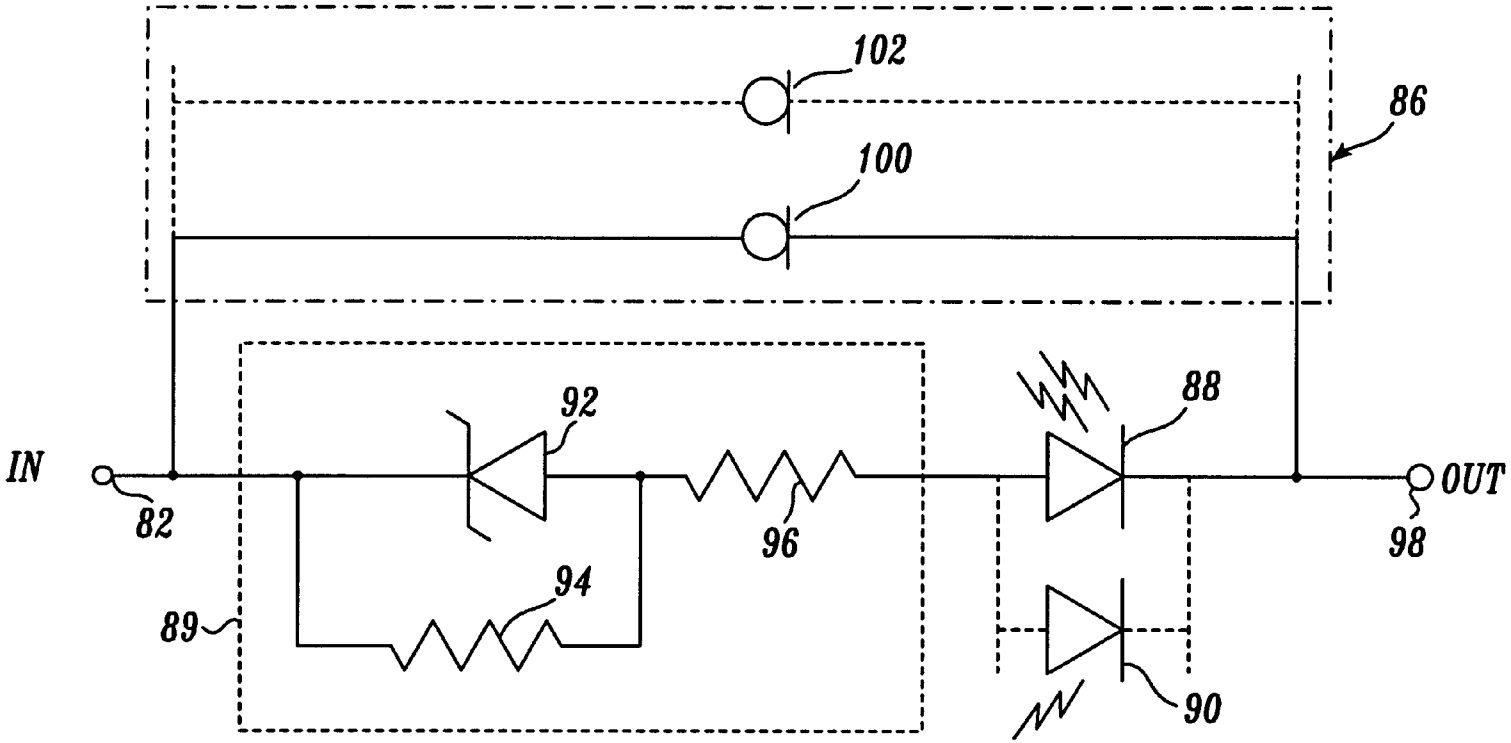
FIG. 8 is a circuit diagram of an alternate embodiment of a compensation circuit formed in accordance with this invention.

In many applications, it may be preferable to match LED luminance to that of an incandescent bulb across a wide range of both input voltages and input currents. In such cases, a voltage compensation block (such as depicted in FIGS. 3 and 4) may be used in conjunction with a current compensation block (depicted in FIG. 6) in the same circuit. This alternate embodiment is depicted in FIG. 8. The circuit of this alternate embodiment includes an input port 82, a voltage compensation block 89, a current compensation block 86, one or more LEDs 88, 90, . . . , and an output port 98. The voltage compensation block 89 is similar to the compensation block 20 depicted in FIG. 3, and includes a zener diode 92 in parallel with a first resistor 94. The zener diode 92 and first resistor 94 are connected in series with a second resistor 96. The voltage compensation block 89 is connected between the input port 82 and the anodes of the LEDs 88, 90, . . . . The current compensation block 86 is connected between the input port 82 and the output port 90, in parallel with the voltage compensation block 89 and the LEDs 88, 90, . . . . As with the compensation block 57 depicted in FIG. 6, the current compensation block 86 includes one or more current diodes 100, 102, . . . . The inclusion of both the current compensation block 86 and the voltage compensation block 89 enables the luminance of the LEDs 88, 90, . . . to approximate the luminance of incandescent bulbs over a wide range of input currents and voltages.

An incandescent luminance matching circuit formed in accordance with the present invention offers many advantages over the prior art. Most importantly, LEDs may be substituted for incandescent bulbs in applications that require LED luminance to be matched to incandescent luminance over a wide range of input voltages or currents. Additionally, an incandescent luminance matching circuit formed in accordance with the present invention provides for an LED light source that produces less heat, operates for a longer life, is less prone to failure in high vibration environments, and consumes less power when compared to an incandescent bulb. Because of these many advantages, LEDs may be readily substituted for incandescent bulbs in many applications.

Those skilled in the art will further appreciate that the present invention can be implemented using devices arranged other than as described in the preferred embodiment. Consequently, within the scope of the claims, it is to be understood that the invention can be practiced otherwise than as specifically described herein.

The embodiments of the invention in which an exclusive property or privilege is claimed are defined as follows:

1. An incandescent bulb luminance matching LED circuit for causing the luminance of a light emitting diode to match the luminance of an incandescent bulb, comprising:

an input port;

an output port;

at least one light emitting diode; and a compensation block connected in circuit with the at least one light emitting diode between the input port and the output port for compensating for at least one parameter of the power applied to the input port such that the luminance of the at least one light emitting diode matches that of an incandescent bulb in response to changes to the at least one parameter.

2. The incandescent bulb luminance matching LED circuit of claim 1, wherein the compensation block comprises a voltage compensation block connected in series with the at least one light emitting diode.

3. The incandescent bulb luminance matching LED circuit of claim 2, wherein the voltage compensation block comprises a zener diode.

4. The incandescent bulb luminance matching LED circuit of claim 3, wherein the voltage compensation block further comprises a first resistor connected in parallel with the zener diode and a second resistor connected in series with the parallel combination of the zener diode and the first resistor.

5. The incandescent bulb luminance matching LED circuit of claim 3, wherein the voltage compensation block further comprises a first resistor connected in series with the zener diode and a second resistor connected in parallel with the series combination of the first resistor and the zener diode.

6. The incandescent bulb luminance matching LED circuit of claim 3, further comprising a plurality of light emitting diodes connected in parallel with one another.

7. The incandescent bulb luminance matching LED circuit of claim 1, wherein the compensation block comprises a current compensation block connected in parallel with the at least one light emitting diode between the input port and the output port.

8. The incandescent bulb luminance matching LED circuit of claim 7, wherein the current compensation block comprises a current diode connected in parallel with the at least one light emitting diode.

9. The incandescent bulb luminance matching LED circuit of claim 7, wherein the current compensation block comprises a plurality of current diodes connected in parallel with the at least one light emitting diode.

10. The incandescent bulb luminance matching LED circuit of claim 7, further comprising a plurality of light emitting diodes connected in parallel with one another.

11. The incandescent bulb luminance matching LED circuit of claim 1, wherein the compensation block comprises a voltage compensation block connected in series with the at least one light emitting diode and a current compensation block connected in parallel with the voltage compensation block and the at least one light emitting diode.

12. The incandescent bulb luminance matching LED circuit of claim 11, wherein the voltage compensation block comprises a zener diode and the current compensation block comprises a current diode.

13. The incandescent bulb luminance matching LED circuit of claim 12, wherein the voltage compensation block further comprises a first resistor connected in parallel with the zener diode and a second resistor connected in series with the parallel combination of the first resistor and the zener diode.

14. The incandescent bulb luminance matching LED circuit of claim 12, wherein the voltage compensation block further comprises a first resistor connected in series with the zener diode and a second resistor connected in parallel with the series combination of the first resistor and the zener diode.

15. The incandescent bulb luminance matching LED circuit of claim 12, wherein the current compensation block further comprises a plurality of current diodes connected in parallel with the at least one light emitting diode.

16. The incandescent bulb luminance compensation LED circuit of claim 12, further comprising a plurality of light emitting diodes connected in parallel with one another.

17. An incandescent bulb luminance matching LED circuit for causing the luminance of a light emitting diode to match the luminance of an incandescent bulb, comprising:

an input port;

an output port;

at least one light emitting diode; and compensation means connected in circuit with the at least one light emitting diode between the input port and the output port for compensating for at least one parameter of the power applied to the input port such that the luminance of the at least one light emitting diode approximates the luminance of an incandescent bulb in response to changes in the at least one parameter.

18. The incandescent bulb luminance matching LED circuit of claim 17, wherein the compensation means comprises a voltage compensation means for compensating for voltage changes in the power applied to the input port.

19. The incandescent bulb luminance matching LED circuit of claim 18, wherein the voltage compensation means comprises a zener diode.

20. The incandescent bulb luminance matching LED circuit of claim 19, wherein the voltage compensation means further comprises a first resistor connected in parallel with the zener diode and a second resistor connected in series with the parallel combination of the zener diode and the first resistor.

21. The incandescent bulb luminance matching LED circuit of claim 19, wherein the voltage compensation means further comprises a first resistor connected in series with the zener diode and a second resistor connected in parallel with the series combination of the first resistor and the zener diode.

22. The incandescent bulb luminance matching LED circuit of claim 19, further comprising a plurality of light emitting diodes connected in parallel with one another.

23. The incandescent bulb luminance matching LED circuit of claim 17, wherein the compensation means comprises a current compensation means for compensating for current changes in the power applied to the input port.

24. The incandescent bulb luminance matching LED circuit of claim 23, wherein the current compensation means comprises a current diode connected in parallel with the at least one light emitting diode.

25. The incandescent bulb luminance matching LED circuit of claim 23, wherein the current compensation means comprises a plurality of current diodes connected in parallel with the at least one light emitting diode.

26. The incandescent bulb luminance matching LED circuit of claim 23, further comprising a plurality of light emitting diodes connected in parallel with one another.

27. The incandescent bulb luminance matching LED circuit of claim 17, wherein the compensation means comprises a voltage compensation means for compensating the voltage changes in the power applied to the input port and a current compensation means for compensating for current changes in the power applied to the input port.

28. The incandescent bulb luminance matching LED circuit of claim 27, wherein the voltage compensation means comprises a zener diode and the current compensation means comprises a current diode.

29. The incandescent bulb luminance matching LED circuit of claim 28, wherein the voltage compensation means further comprises a first resistor connected in parallel with the zener diode and a second resistor connected in series with the parallel combination of the first resistor and the zener diode.

30. The incandescent bulb luminance matching LED circuit of claim 28, wherein the voltage compensation means further comprises a first resistor connected in series with the zener diode and a second resistor connected in parallel with the series combination of the first resistor and the zener diode.

31. The incandescent bulb luminance matching LED circuit of claim 28, wherein the current compensation means further comprises a plurality of current diodes connected in parallel with the voltage compensation means and the at least one light emitting diode.

32. The incandescent bulb luminance matching LED circuit of claim 28, further comprising a plurality of light emitting diodes connected in parallel with one another.

* * * * *